United States Patent [19]

Carlson

[11] 4,359,993

[45] Nov. 23, 1982

[54] INTERNAL COMBUSTION ENGINE TRANSIENT FUEL CONTROL APPARATUS

[75] Inventor: Clifford R. Carlson, Fenton, Mich.

[73] Assignee: General Motors Corporation, Detroit, Mich.

[21] Appl. No.: 228,136

[22] Filed: Jan. 26, 1981

[51] Int. Cl.[3] ..... F02M 51/00; F02B 3/00

[52] U.S. Cl. ..... 123/492; 123/493

[58] Field of Search ..... 123/492, 493, 445, 462, 123/463

[56] References Cited

U.S. PATENT DOCUMENTS

| | | | |
|---|---|---|---|
| 3,548,791 | 7/1968 | Long | 123/492 |
| 3,623,459 | 11/1971 | Gordon | 123/492 |
| 3,692,003 | 9/1972 | Wakamatsu et al. | 123/492 |
| 3,719,176 | 3/1973 | Shinoda et al. | 123/492 |
| 3,747,576 | 7/1973 | Gordon et al. | 123/492 |
| 3,759,231 | 9/1973 | Endo | 123/492 |
| 3,842,811 | 10/1974 | Shinoda et al. | 123/492 |
| 3,858,561 | 1/1975 | Aono | 123/492 |
| 3,935,851 | 2/1976 | Wright et al. | 123/462 |
| 4,010,717 | 3/1977 | Taplin | 123/492 |
| 4,144,847 | 3/1979 | Hosaka | 123/492 |

*Primary Examiner*—Raymond A. Nelli

*Attorney, Agent, or Firm*—Robert M. Sigler

[57] ABSTRACT

Transient fuel control apparatus for an above the throttle fuel injected internal combustion engine includes apparatus effective to measure the time rate of change of throttle position and periodically derive therefrom a first transient correction number, apparatus effective to generate a first order lag filtered induction passage pressure signal, apparatus effective to derive rate of change of the induction passage pressure relative to the filtered induction passage pressure signal and derived therefrom a second transient fuel correction number and apparatus effective to modify the fuel injected into the induction passage from the quantity normally injected during steady state engine operation by an amount derived from the arithmetic sum of the first and second transient fuel correction numbers. The first transient fuel correction number may be calibrated independently to correct for change in the fuel supply necessary due to immediate change in the air flow past the throttle with a change in throttle position; the second transient fuel correction number may be independently calibrated to correct fuel supply for the change necessary due to changes in fuel stored within the manifold under varying induction passage pressure. If the engine includes an idle air bypass passage with an idle air control valve therein, a third transient fuel correction number based on the time rate of change of idle air control valve position may be added to the other to transient fuel correction numbers.

3 Claims, 5 Drawing Figures

INTERNAL COMBUSTION ENGINE TRANSIENT FUEL CONTROL APPARATUS

BACKGROUND OF THE INVENTION

This invention relates to transient fuel control apparatus for an internal combustion engine and particularly for such an engine provided with above the throttle fuel injection. With such a system, air flow to the engine is varied by the vehicle operator through a throttle valve in a throttle body and fuel is injected through one or more injectors mounted upstream from the throttle in response to a control signal derived from a pair of engine operating parameters such as engine speed and a load indicating factor such as the pressure below the throttle in the throttle body or intake manifold. Especially when supplemented by a closed loop air/fuel ratio control system, such apparatus can provide good control of air/fuel ratio at a substantially stoichiometric ratio to provide efficient reduction of undesirable emissions in a three-way catalytic converter under substantially steady engine operating conditions.

If the engine throttle is moved substantially, however, and particularly if it is moved quickly, transient conditions are created which can cause temporary but significant deviations from the desired air/fuel ratio and thus momentarily but significantly decrease converter efficiency for one or more of the undesirable emissions. It is well known, in general, that extra fuel must be added to the engine as the throttle opens and must be withheld from the engine as the throttle closes if a substantially constant air/fuel ratio is to be maintained during these transient conditions. However, the precise amount and timing of the fuel addition or subtraction required has proved to be difficult to attain.

One approach of the prior art is shown in the U.S. Pat. to Endo No. 3,759,231, in which a first order lag filtered value of manifold pressure is subtracted from the present value of manifold pressure to generate a difference signal varying with the rate of change of manifold pressure relative to the filtered value; and this signal determines the amount of extra fuel to be added. However, in the U.S. Pat. Nos. to Shinoda et al 3,719,176 and 3,842,811, the patentees point out that there is a delay time involved in manifold pressure responsive systems; and they themselves describe a system in which transient fuel control is triggered by a significant rate of change in throttle position. Since the transient correction is generally required over a longer period of time than that of the throttle movement itself, Shinoda et al provides an initial extra amount of fuel dependent in quantity on the size of the rate of change of throttle movement with additional pulses following in quantities that decrease over time. While it is true that detection of throttle movement provides a faster response to the transient condition than does the detection of a change in manifold pressure, this type of system has proved relatively difficult to calibrate exactly for the many different sizes of transient correction and initial engine conditions. For example, the engine may be calibrated to respond correctly to a wide open throttle acceleration at low engine speed with an initial amount of extra fuel and rate of decay that is inappropriate for the same wide open throttle acceleration initiated when the engine is at a significantly higher engine speed. In practice, this approach tends to involve increasing numbers of provisions for one factor or special case after another with different system gains and amounts until the total system is extremely complex; and even then there generally appears to be an engine operating condition for which it could be improved.

SUMMARY OF THE INVENTION

It is therefore an object of this invention to provide a transient fuel control apparatus for a fuel injected internal combustion engine which provides accurate control of air/fuel ratio to the engine under the greatest variety of engine transient operating conditions.

It is a further object of this invention to provide such a control which can be easily calibrated on an engine for all the various transient conditions expected.

In order to accomplish these objectives, this invention comprises apparatus which measures the time rate of change of throttle position and derives therefrom a first transient fuel correction number which is independently calibrated to correct the fuel supply for the immediate change in air flow past the throttle with said change in throttle position. The apparatus further derives a filtered induction passage pressure with a first order lag characteristic from the measured induction passage pressure, computes the time rate of change of the induction passage pressure relative to the filtered induction passage pressure and derives therefrom a second transient fuel correction number which is independently calibrated to correct fuel supply for the change in fuel stored in the induction passage with the change in pressure therein. The apparatus further adds the first and second transient fuel correction numbers arithmetically and modifies the fuel injected into the induction passage according to this sum to increase or decrease fuel as required. In the case of an opening throttle, this fuel is added immediately in a separate pulse or, if a fuel injection pulse is already in progress, is added to the end of that pulse. In the case of throttle closing, the next pulse to be delivered is shortened by an amount dependent upon the sum. In the case of an engine equipped with a throttle bypass passage with an idle air control valve therein, a third transient fuel correction number is derived from movement of the idle air control valve and this number is added to the sum of the first and second transient fuel control numbers.

This invention is thus an improvement over the prior art in which those skilled in the art either argued over which of the throttle position or induction passage pressure was the best indication of a transient operating condition or, in some cases, considered them equivalent. In actual fact, a change in throttle position is an excellent indication of a need for transient fuel correction for air flowing past the throttle. This is particularly the case in an above the throttle fuel injection system where the fuel must be added, in the case of opening throttle, immediately. The change required is immediate, large and usually of short duration. The change produced by the time rate of change of throttle position is immediate and of short duration and can be calibrated to be as large as desired.

On the other hand, an additional correction must be made for the effect of changing induction passage pressure within the manifold. There is always some fuel stored on the walls of the manifold, the amount of which depends on the pressure within the manifold and thereby changes therewith. If manifold pressure is increased, the amount of fuel stored on the wall thereof also increases and the amount available for the engine is therefore temporarily decreased. The correction required for this phenomenon is slower and longer lasting than that required for the change in throttle position; and the time rate of change of induction passage pressure with respect to a lag filtered induction passage pressure provides such a correction which may be calibrated both in amount and duration as required.

The sum of these corrections at any given moment comprises the total fuel correction in a manner that is easy to calibrate and provides for most of the anticipated engine transient operating conditions. Further details and advantages of this invention will be apparent from the accompanying drawings and following description of a preferred embodiment.

DESCRIPTION OF THE PREFERRED EMBODIMENT

Figure 1:
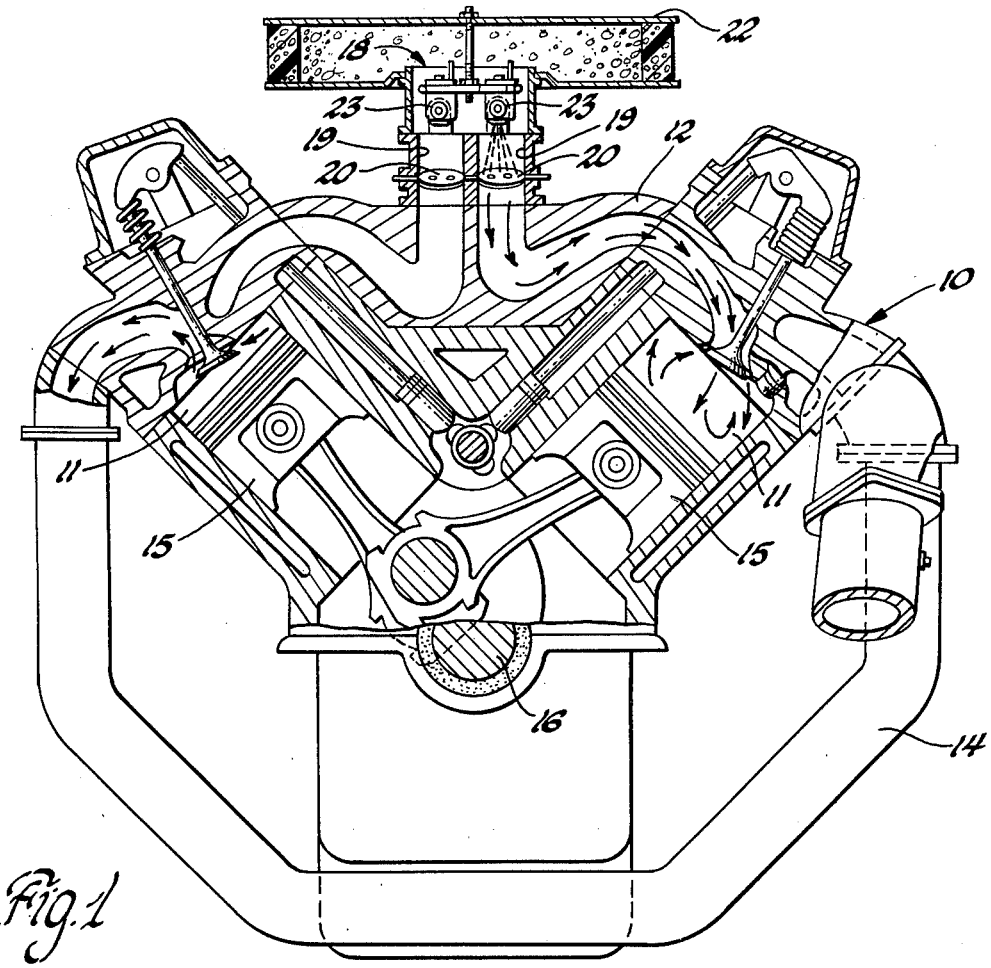
FIG. 1 shows a partially cutaway view of an internal combustion engine having an above the throttle fuel injection system.

Referring to FIG. 1, a spark ignited internal combustion engine 10 has a plurality of cylinders 11, an intake manifold 12 adapted to convey an air/fuel mixture to the cylinders 11 and an exhaust conduit 14 effective to convey combustion products and other emissions out of cylinders 11. Pistons 15 and cylinders 11 cause rotation of a crankshft 16 in engine operation.

A throttle body 18 includes one or more induction passages 19 (in this embodiment, two) with a throttle valve 20 in each to control the air flow therethrough, the throttle valves 20 being operated on a common shaft. An air cleaner 22 removes incoming air of harmful matter; and a fuel injector 23 is positioned in each induction passage above the throttle valve to inject fuel, when actuated, into the incoming air. It can be seen from FIG. 1 that fuel is added to the air in a spray of fine droplets at a point near throttle valve 20 and that the air and fuel have an opportunity to mix into a more homogeneous mixture as they pass through intake manifold 12. Some of the fuel, however, is stored on the inner walls of intake manifold 12, the amount varying with the pressure within intake manifold 12. During steady state engine operating conditions, the amount of stored fuel changes very little; however, if the pressure within intake manifold 12 changes due to variations in the position of throttle valves 20, stored fuel will be added to the induction mixture in the case of a decreasing pressure and removed from the induction mixture in the case of an increasing pressure. In addition, if the throttle valve 20 is opened suddenly, an increased mass of air will immediately flow thereby at a high speed as the pressure attempts to equalize within the intake manifold 12. If this increased air is to be fueled, the fuel must be added immediately as the air passes the injector or throttle.

Figure 2:
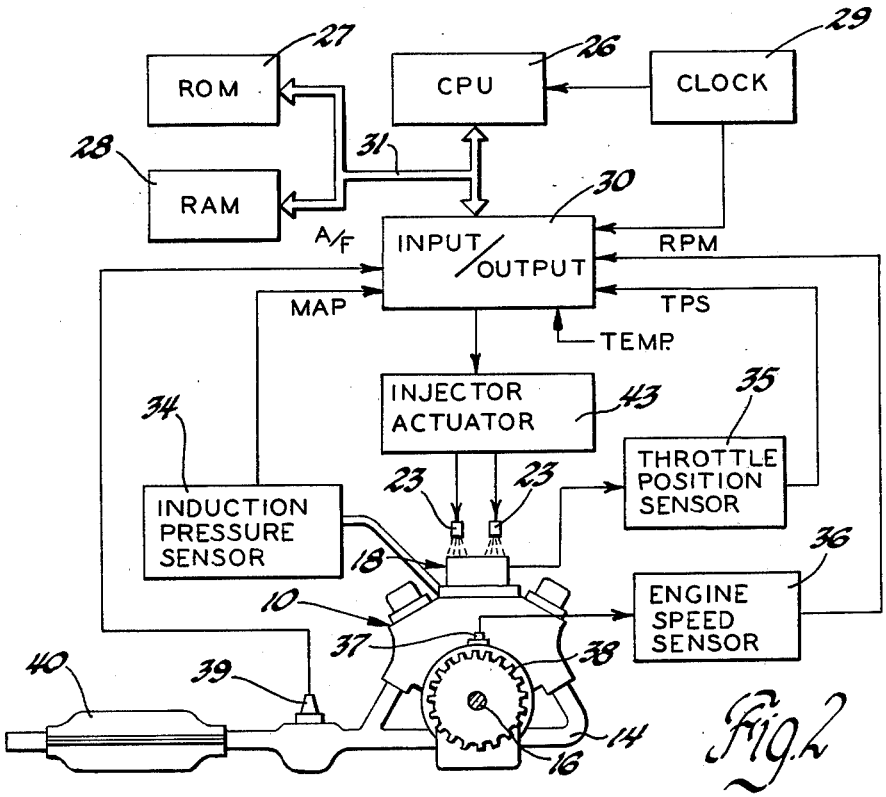
FIG. 2 is a block diagram of apparatus according to this invention for use with the engine of FIG. 1.

FIG. 2 shows a block diagram of the fuel control system of this invention used with the engine of FIG. 1. Digital computing and control apparatus includes a central processing unit (CPU) 26, a read only memory (ROM) 27, a random access memory (RAM) 28, a clock 29 and input/output apparatus 30. An example of suitable apparatus is the Motorola 6800 series of microprocessor and supporting chips with appropriate input/output apparatus well known to those skilled in the art. CPU 26, ROM 27, RAM 28 and input/output apparatus 30 are all interconnected in the normal manner by appropriate data and address buses and other lines, which are represented by the bus 31. Signals from clock 29 are provided to the other chips in the normal manner.

Engine 10 is provided with an induction pressure sensor 34 sensitive to pressure within intake manifold 12 below throttle 20, a throttle position sensor 35 effective to signal the rotary position of throttle valves 20, an engine speed sensor 36 which may include a magnetic pickup 37 positioned to sense the passage of teeth of a flywheel 38 rotating with crankshaft 16, and an air/fuel ratio sensor 39 mounted in exhaust conduit 14 upstream of a catalytic converter 40. The analog signals A/F from air/fuel ratio sensor 37, MAP from induction pressure sensor 34 and TPS from throttle position sensor 35, as well as a signal TEMP from an engine coolant temperature sensor, not shown, are all provided to input/output apparatus 30 in which they are sampled and converted to appropriate digital form for use by CPU 26. Engine speed sensor 36 may contain apparatus suitable to time the pulse output of the magnetic pickup and convert it to an analog engine speed signal RPM, which is conveyed to input/output apparatus 30 and converted to a digital word for use by CPU 26. Alternatively, engine speed sensor 36 can include counter means which are timed to count the pulses from magnetic pickup and periodically convey the digital count itself to input/output apparatus 30 for use by CPU 26. Finally, input/output apparatus 30 includes output pulse generating means effective to actuate an injector actuator 43, which, in turn, actuates the injectors 23 for the duration of the pulses.

Figure 3:
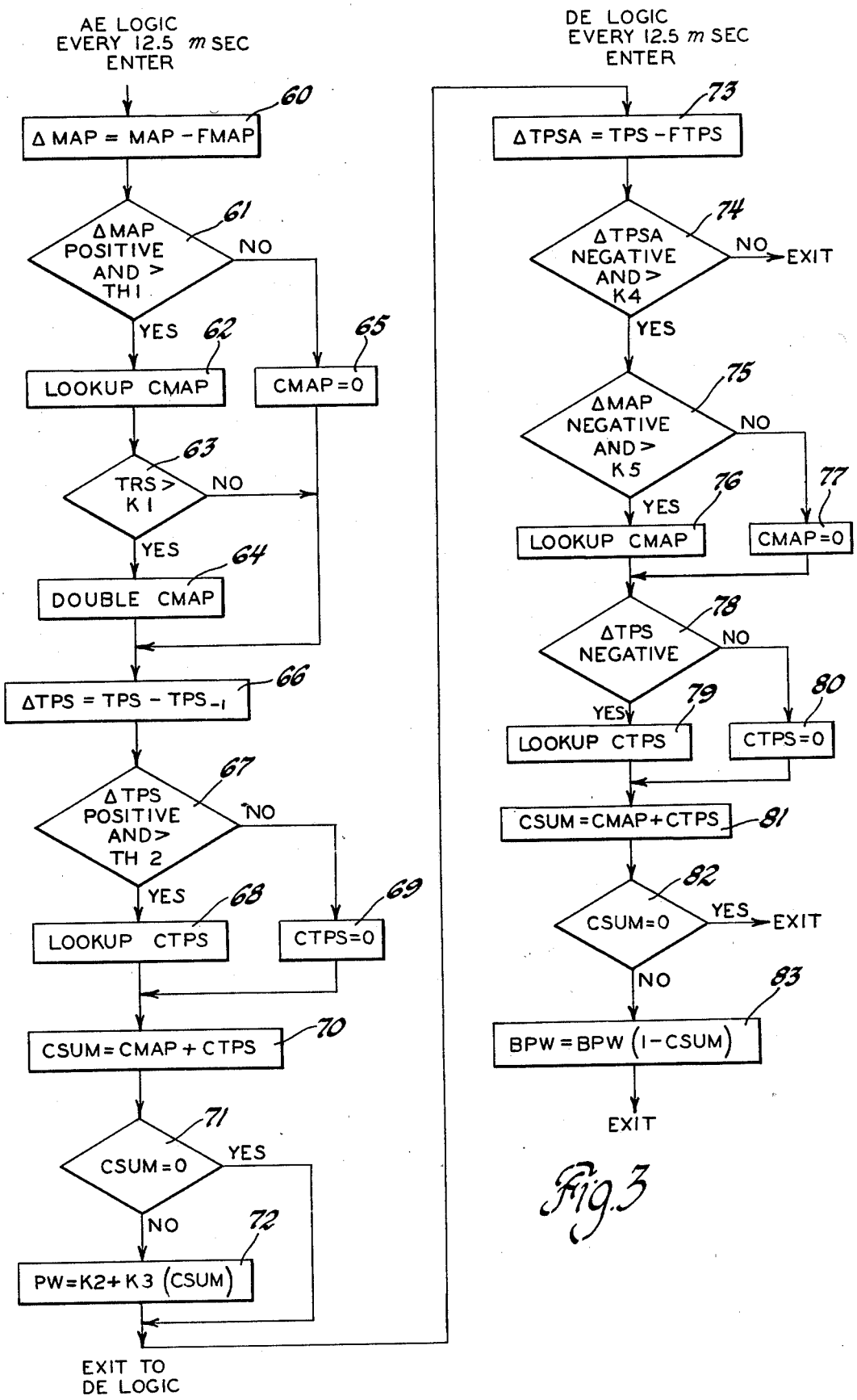
FIGS. 3 and 4 are computer flow charts describing the operation of the apparatus of FIG. 2.
Figure 4:
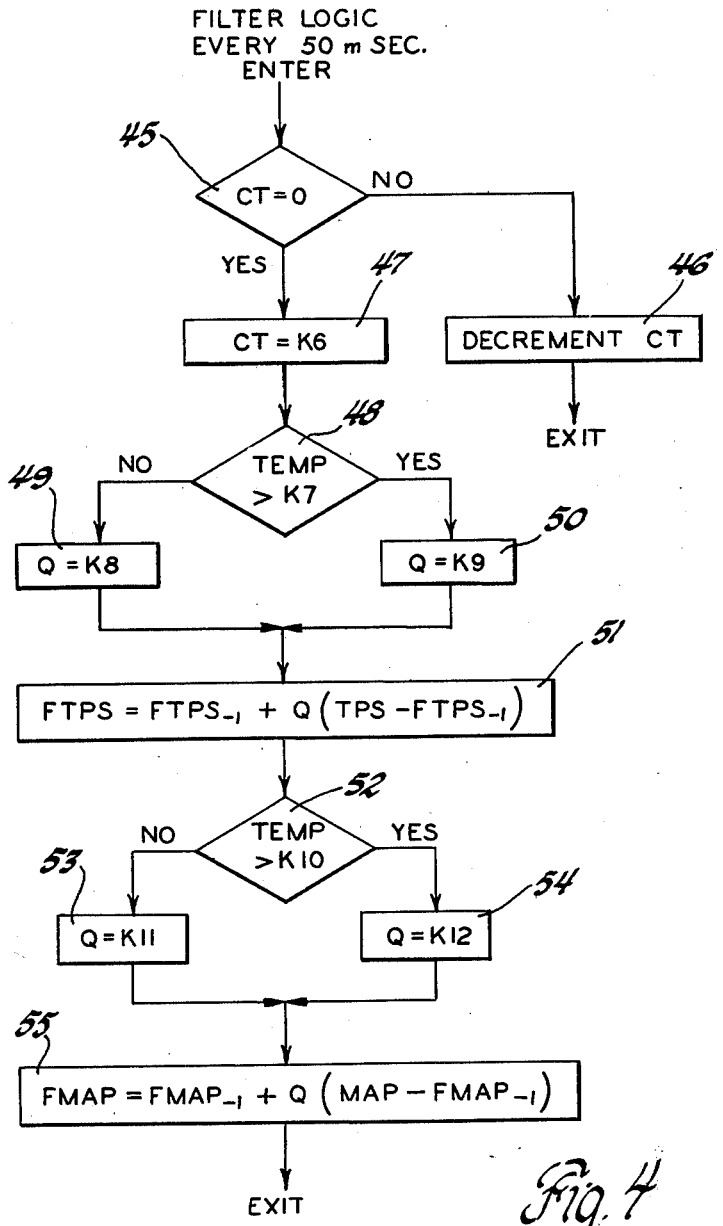

The apparatus of FIG. 2 is controlled according to a stored program of instructions contained within ROM 27 and executed by CPU 26 at a rate determined by clock 29. FIGS. 3 and 4 show computer flow charts which describe the operation of this control.

Referring first to FIG. 4, the filter logic is performed every 50 milliseconds. This program is entered at a decision point 45 which determines whether a count CT is equal to 0. If not, the count is decremented in step 46 and the filter logic program exited. If so, however, the count is reset to a constant K6 in step 47 and the program proceeds to another decision point 48. The count CT determines the number of 50 millisecond periods between each updating of the filtered values of throttle position and induction pressure and thus the time constant of the first order lag filter. A typical value for count CT is 20.

In decision point 48, engine coolant temperature TEMP is compared with a constant K7 to determine whether the engine is warmed up. A calibration number Q is set equal to constant K8 in step 49 for a cold engine and is set equal to a constant K9 in step 50 for a warm engine; and the program proceeds to step 51 in which a new filtered throttle position FTPS is computed according to the equation FTPS equals $FTPS_{-1}+Q(TPS-FTPS_{-1})$, where $FTPS_{-1}$ is the last computered filter throttled position and TPS is the new measured throttle position.

From step 51 the program proceeds to decision point 52 in which engine coolant temperature is compared with a constant K10. For a cold engine the calibration quantity Q is set equal to a constant K11 in step 53; and for a warm engine the calibration constant Q is set equal to a constant K12 in step 54. The program then proceeds to step 55 in which a filtered value of induction passage pressure FMAP is calculated by an equation analogous to that for FTPS: $FMAP=FMAP_{-1}+Q(MAP-FMAP_{-1})$, wherein $FMAP_{-1}$ is the previously calculated value of FMAP and MAP is the present value of manifold absolute pressure. The program then exits the filter logic.

FIG. 3 describes the transient control program which includes acceleration enrichment and deceleration enleanment logic and is run every 12.5 milliseconds. The program first enters the acceleration enrichment or AE logic at step 60 in which DELTA MAP is calculated as MAP−FMAP. Decision pooint 61 then determines whether DELTA MAP is positive and greater than a threshold TH1. If it is, a first transient fuel correction number CMAP is obtained from a lookup table in ROM 27 referenced by DELTA MAP in step 62 and throttle position TPS is compared with a constant K1 in decision point 63. If TPS is greater than K1, the value of CMAP is doubled in step 64; and the program proceeds to step 66. If DELTA MAP was not positive and greater than TH1 in decision point 61, the program proceeds through step 65, in which CMAP is set equal to 0, directly to step 66. The program also proceeds directly to step 66 from decision point 63 if TPS is not greater than K1. The doubling of CMAP in step 65 is found to be helpful at large throttle openings.

In step 66 a quantity DELTA TPS is calculated as $TPS-TPS_{-1}$, or the difference between the present reading of throttle position and the last recorded reading thereof. The program next proceeds to decision point 67, in which it is determined whether DELTA TPS is positive and greater than a threshold TH2. If it is, a second transient fuel correction number CTPS is obtained from a lookup table in ROM 27 referenced by DELTA TPS in step 68. If not, CTPS is set equal to 0 in step 69.

The program then proceeds to step 70 in which CMAP and CTPS are added to form the quantity CSUM, and then to decision point 71, in which CSUM is checked for 0. If it is 0, the program exits to the deceleration enleanment or DE logic; but if it is not, a pulse width number PW is derived in step 72 according to the equation PW=K2+K3(CSUM), where K2 and K3 are calibration constants. PW represents the pulse width of an extra fuel pulse to be delivered immediately to the injector actuator or added to the pulse presently being delivered.

The program then enters the deceleration enleanment or DE logic at step 73, in which a quantity DELTA TPSA is calculated according to the equation DELTA TPSA=TPS−FTPS. The program then proceeds to decision point 74, in which DELTA TPSA is checked to see if it is negative and greater in absolute value than a constant K4. This is a test inserted to detect a true deceleration condition. Otherwise, during some engine operating conditions such as idle, where MAP can change rapidly, the mixture might be leaned by the DELTA MAP function described below, leading to possible instability of engine operation and stall. This test is not required for enrichment, since an enrichment due to DELTA MAP changes does not appear to destabilize the engine operation. If it is not, the program exits; but if it is, the program proceeds to decision point 75, in which DELTA MAP, already computed, is checked to see if it is both negative and greater in absolute value than a constant K5. If it is, then, in step 76, the quantity CMAP is derived from a lookup table in ROM 27 referenced by DELTA MAP. If it is not, the quantity CMAP is set equal to 0 in step 77.

The program then proceeds to decision point 78, in which DELTA TPS, already computed, is checked to see if it is negative. If it is, then, in step 79, the quantity CTPS is derived from a lookup table in ROM 27 referenced by DELTA TPS. If it is not, then CTPS is set equal to 0 in step 80. The program then proceeds to step 81 in which CMAP and CTPS are added to form CSUM. Next, in decision point 82, CSUM is checked for 0 and, if it is, the program exits. If not, in step 83 the base pulse width BPW of the next regular fuel injection pulse, which has been calculated in a different part of the program, not shown, is reduced according to the equation BPW equals BPW(1−CSUM). With the equation in this form, CSUM would be a fraction between 0 and 1 so that BPW is actually reduced by this equation. However, the computer would actually use whole binary numbers, so that expression would look somewhat different.

Figure 5:
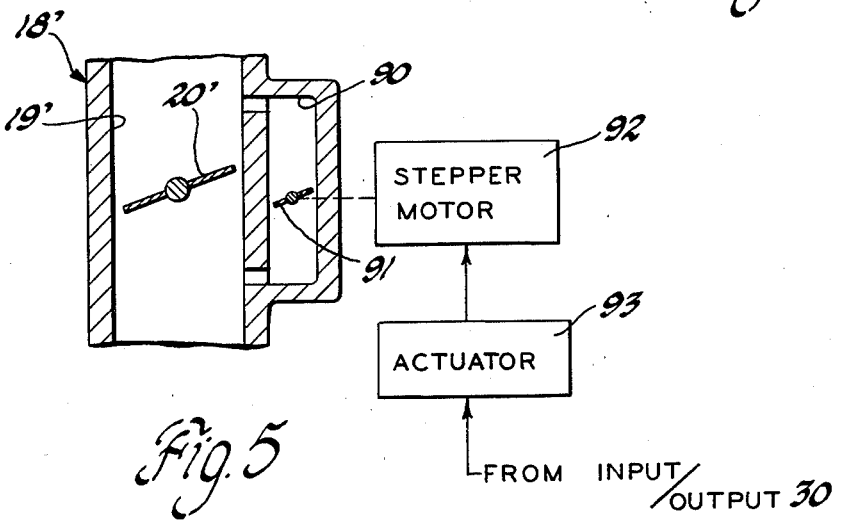
FIG. 5 is a cutaway view of a portion of a modified throttle body which could be used on the engine of FIG. 1 with this invention.

FIG. 5 shows a portion of a modified throttle body 18′ including, in addition to the normal induction passage 19′ and throttle 20′, a throttle bypass passage 90 with an idle air control valve 91 therein. Bypass passage 90 and idle air control valve 91 allow control of idle air flow when main throttle valve 20′ is closed. Idle air control valve 91 is positioned by a stepper motor 92 in response to signals from an actuator 93 which obtains signals from input/output apparatus 30. It is controlled according to an idle air control routine stored in ROM 27 and not described in this specification. If such apparatus is used with engine 10, however, it is necessary to modify the flow chart of FIG. 3 just prior to step 70 by checking to see if the idle air control valve 91 has moved in the opening direction since the last cycle of the program and if it has, by deriving a third transient fuel correction number from a memory location or lookup table in ROM 27. The equation in step 70 would also be modified by the addition of the third transient fuel control number to the sum of CMAP and CTPS with the calibration numbers K2 and K3 in step 72 adjusted accordingly. In this way, the increased air flow due to the opening of idle air control valve 91 is treated similarly to the increased air flow due to the opening of throttle valve 20′. If it is desired, a similar modification could be performed to the DE logic at step 81 for closing movements of idle air control valve 91. However, it is not been found to this date to be necessary to do so.

The embodiments of the invention in which an exclusive property or privilege is claimed are defined as follows:

1. In a spark ignition internal combustion engine having an air induction passage with a throttle therein and means responsive at least to induction passage pressure and engine speed to normally inject fuel into said induction passage upstream from said throttle in quantity appropriate for essentially steady state engine operating conditions, transient fuel control apparatus comprising:

first means effective to measure the time rate of change of throttle position and periodically derive therefrom a first transient fuel correction number, said number being independently calibrated to correct fuel supply for the immediate change in air flow past the throttle with change in throttle position;

second means responsive to the induction passage pressure to derive therefrom a filtered induction passage pressure with a first order lag characteristic;

third means responsive to the induction passage pressure and the second means to derive the time rate of change of the induction passage pressure relative to the filtered induction passage pressure and derive therefrom a second transient fuel correction number, said number being independently calibrated to correct fuel supply for the change in fuel stored in the induction passage with change in pressure therein; and fourth means effective to modify the fuel injected into the induction passage from said quantity normally injected by an amount derived from the arithmetic sum of the first and second transient fuel correction numbers, whereby accurate transient fuel control is obtained under a variety of engine operating conditions.

2. In a spark ignited internal combustion engine having an air induction passage with a throttle therein, a bypass passage around said throttle with an idle air control valve therein and means responsive at least to induction passage pressure and engine speed to normally inject fuel into said induction passage upstream from said throttle in quantity appropriate for essentially steady state engine operating conditions, transient fuel control apparatus comprising:

first means effective to measure the time rate of change of throttle position and periodically derive therefrom a first transient fuel correction number, said number being independently calibrated to correct fuel supply for immediate change in air flow past the throttle with change in throttle position;

second means responsive to the induction passage pressure to derive therefrom a filtered induction passage pressure with a first order lag characteristic;

third means responsive to the induction passage pressure and the second means to derive the time rate of change of the induction passage pressure relative to the filtered induction passage pressure and derive therefrom a second transient fuel correction number, said number being independently calibrated to correct fuel supply for the change in fuel stored in the induction passage with change in pressure therein;

fourth means effective to measure the time rate of change of idle air control valve position and periodically derive therefrom a third transient fuel correction number, said number being independently calibrated to correct fuel supply for the immediate change in air flow past the idle air control valve with a change in the position of said valve; and fifth means effective to modify the fuel injected into the induction passage from said quantity normally injected under steady state conditions by an amount derived from the arithmetic sum of the first, second and third transient fuel correction numbers, whereby accurate transient fuel control is obtained under a variety of engine operating conditions.

3. In a spark ignited internal combustion engine having an air induction passage with a throttle therein and means responsive at least to induction passage pressurein engine speed to normally inject fuel into said induction passage upstream from said throttle in quantity appropriate for essentially steady state engine operating conditions, transient fuel control apparatus comprising:

first means effective to measure the time rate of change of throttle position and periodically derive therefrom a first transient fuel correction number, said number being independently calibrated to correct fuel supply for the immediate change in air flow past the throttle with change in throttle position;

second means responsive to the induction passage pressure to derive therefrom a filtered induction passage pressure with a first order lag characteristic;

third means responsive to the induction passage pressure and the second means to derive the time rate of change of the induction passage pressure relative to the filtered induction passage pressure and derive therefrom a second transient fuel correction number, said number being independently calibrated to correct fuel supply for the change in fuel stored in the induction passage with change in pressure therein;

fourth means effective to compare throttle position with a predetermined reference and double the value of the second transient fuel correction number when the throttle position exceeds said predetermined reference; and fifth means effective to modify the fuel injected into the induction passage from said quantity normally injected by an amount derived from the arithmetic sum of the first and second transient fuel correction numbers, whereby accurate transient fuel control is obtained under a variety of engine operating conditions.

* * * * *